US005380065A

United States Patent [19]

Rohrer

[11] Patent Number: 5,380,065

[45] Date of Patent: Jan. 10, 1995

[54] MECHANICAL LINKAGE FOR AN ARM REST

[75] Inventor: Daniel F. Rohrer, Powell Butte, Oreg.

[73] Assignee: Reimers Furniture Mfg., Inc., Hillsboro, Oreg.

[21] Appl. No.: 173,201

[22] Filed: Dec. 22, 1993

[51] Int. Cl.[6] ..... A47C 7/54

[52] U.S. Cl. ..... 297/411.37; 297/411.35

[58] Field of Search ..... 297/411.2, 411.3, 411.31, 297/411.35, 411.37, 411.38, 115, 116; 248/118

[56] References Cited

U.S. PATENT DOCUMENTS

| | | | |
|---|---|---|---|
| 762,877 | 6/1904 | Browne | 297/411.37 |
| 988,923 | 4/1911 | Bauerfeind | 248/118 |
| 1,266,367 | 5/1918 | Wilson | 248/118 X |
| 2,614,558 | 10/1952 | Lovell | 248/118 X |
| 3,124,328 | 3/1964 | Kortsch . | |
| 3,216,764 | 11/1965 | Junkunc | 297/411.37 X |
| 3,366,430 | 1/1968 | Diedrich | 297/411.31 X |
| 4,159,093 | 6/1979 | Hamilton | 248/118 X |
| 4,913,393 | 4/1990 | Wood | 297/411.37 X |
| 5,171,317 | 12/1992 | Corcoran | 297/411.31 X |
| 5,281,001 | 1/1994 | Bergsten et al. | 297/411.35 X |

*Primary Examiner*—Peter R. Brown
*Assistant Examiner*—Milton Nelson, Jr.
*Attorney, Agent, or Firm*—Chernoff, Vilhauer, McClung & Stenzel

[57] ABSTRACT

A mechanical linkage for an arm rest is disclosed comprising an elongate component defining an opening proximate each of two ends of the component. A first shaft is fixed at one end to a base and a second end is rotatably coupled to the elongate component at a first opening. A second shaft is fixed at one end to an arm rest support and a second end is rotatably coupled to the elongate component at the second opening. A pressure adjustment mechanism adjustably contacts the shafts for adjusting the force required to position the arm rest. The pressure adjustment mechanism is initially set to provide the desired resistance to movement and need only be readjusted to compensate for wear.

8 Claims, 2 Drawing Sheets

MECHANICAL LINKAGE FOR AN ARM REST

BACKGROUND OF THE INVENTION

This invention relates to furniture construction, and more particularly to a mechanical linkage for rotatably linking an arm rest relative to the base on which it is mounted.

A person who spends many hours a day seated in a chair needs to frequently alter position to ease the strain on the musculoskeletal system. Secretaries and other office personnel in particular must be comfortably seated in well-fitting chairs to avoid certain over-use injuries such as Carpal Tunnel Syndrome, neck and back strain. To avoid such injuries, a well-fitting chair should preferably include an adjustable arm rest to provide maximum support for the back and arms of the seated person.

U.S. Pat. No. 3,124,328 to Kortsch discloses an adjustable arm rest for a dental chair. However, the arm rest does not include any mechanism for adjusting the force required to modify the arm rest position.

What is still needed is an office chair with an arm rest which is rotatably adjustable to support the arm of the seated person in a selected position, and which will reliably remain in the selected position until repositioned as desired.

SUMMARY OF THE INVENTION

The present invention overcomes the foregoing drawbacks of the prior art by providing for a chair arm rest a mechanical linkage between an arm rest base and a support to which the arm rest is attached. The mechanical linkage includes an elongate component which is rotatably attached at one of its ends to the base, and at its other end to the arm rest support. A pressure adjustment mechanism, which adjustably contacts the rotating mechanism at each end of the elongate component, sets the force required to position the arm rest.

The mechanical linkage thus permits the arm rest to be located at any of a wide range of positions. The pressure adjustment mechanism is initially set to provide the desired tension and resistance to movement of the arm rest, which insures that the arm rest will remain in the selected position until a new position is intentionally selected. The tension need not be readjusted unless wear from use causes a loosening of the desired tension, making a readjustment necessary.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
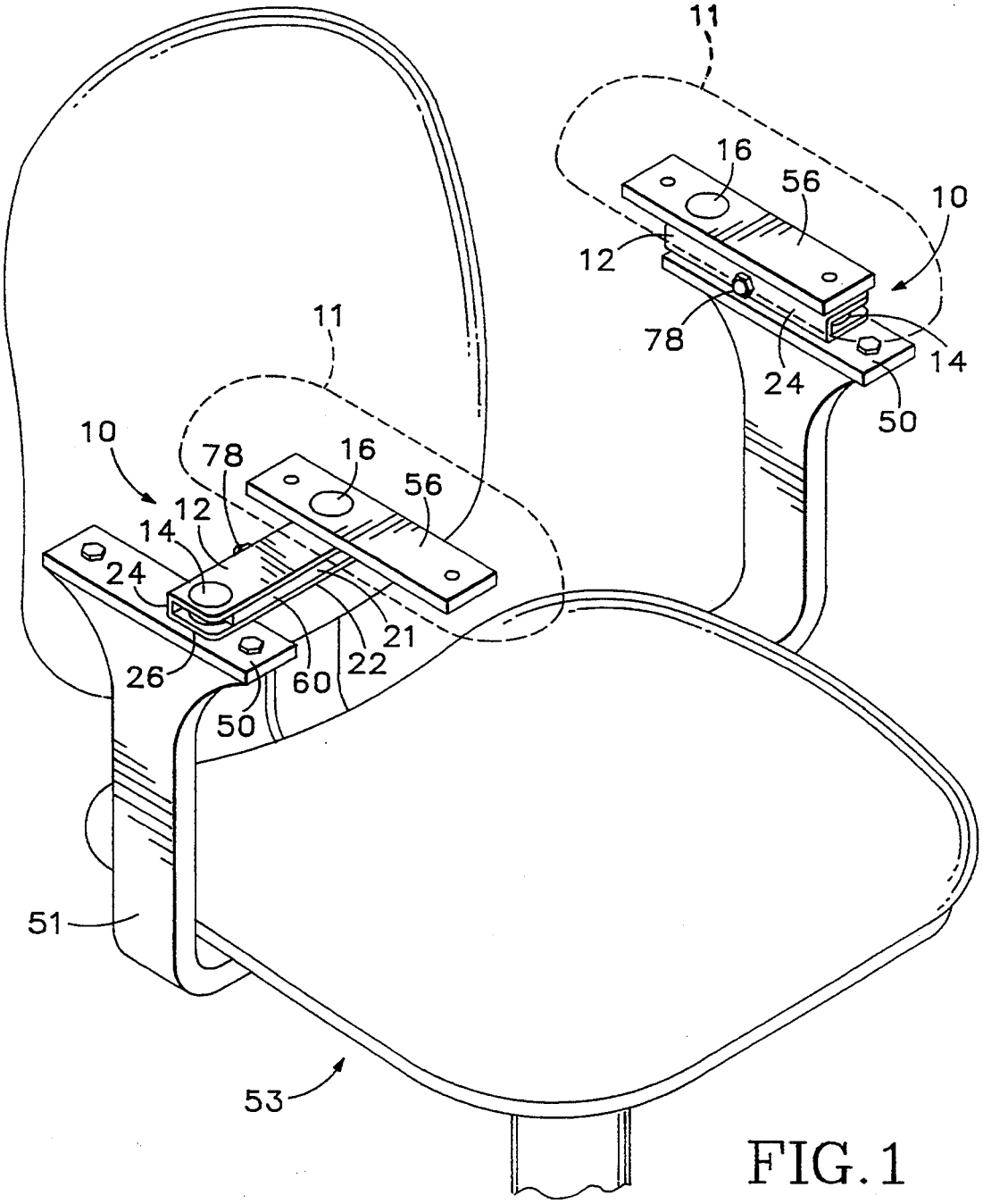
FIG. 1 is a perspective view of a mechanical linkage for a chair arm rest embodying the present invention.
Figure 2:
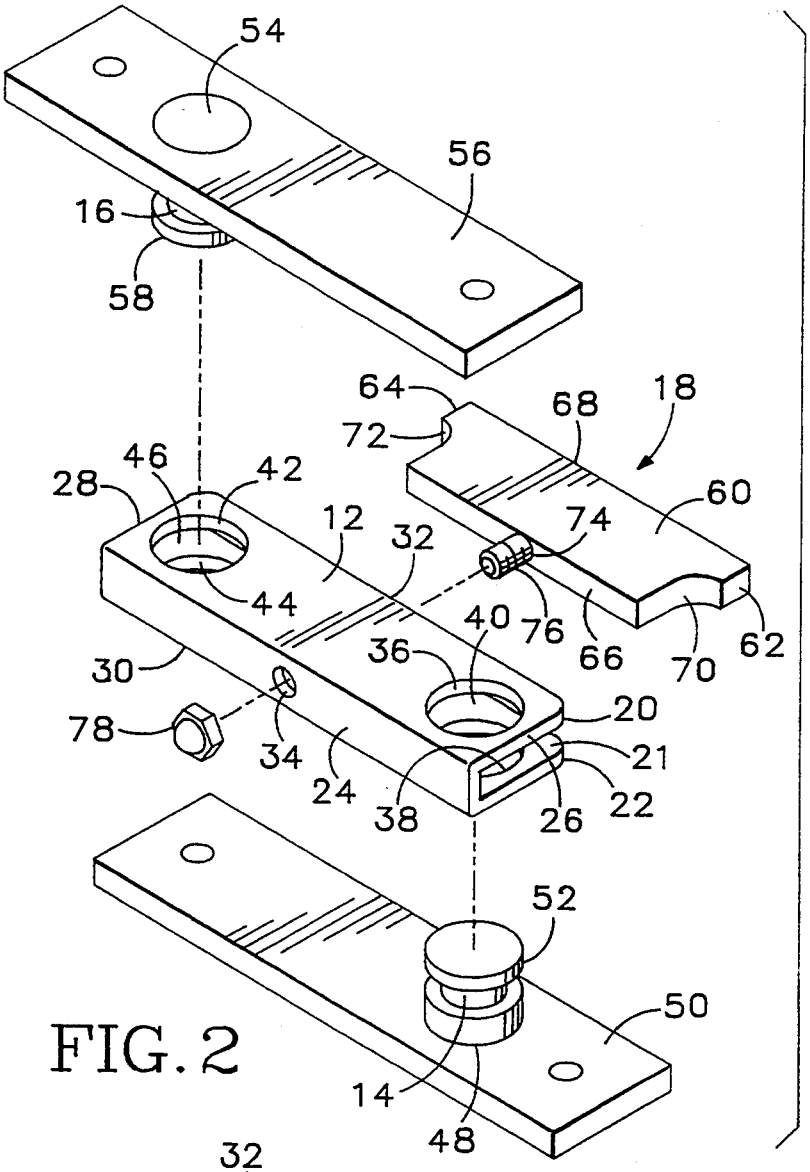
FIG. 2 is an enlarged exploded view of the mechanical linkage shown in FIG. 1.
Figure 3:
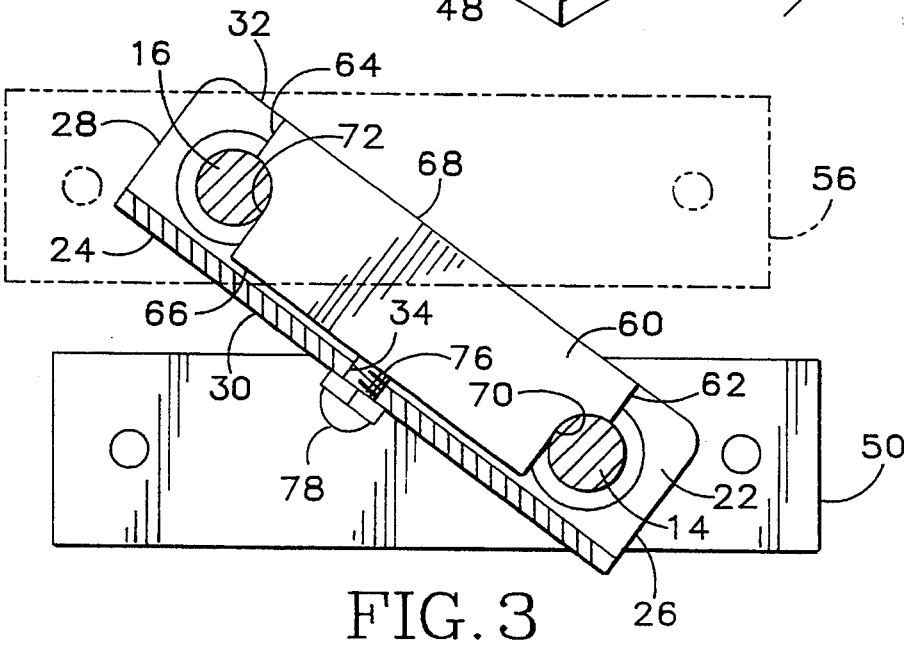
FIG. 3 is an enlarged sectional view of the mechanical linkage with a portion of the arm rest support shown in broken line.

Referring now to the drawings, a mechanical linkage 10 for an arm rest 11 includes an elongate component 12, having two shorter ends 26, 28 and two longer ends

30, 32. In a preferred embodiment the elongate component 12 includes an upper portion 20 and a substantially parallel lower portion 22 which are interconnected by an end portion 24 to form a slot 21 between them. The end portion 24 defines a medially located hole 34.

An opening is defined proximate each shorter end 26, 28 of the elongate component. A first aperture 36 in the upper portion 20 and a first aperture 38 in the lower portion 22, each proximate the first end 26, are axially aligned to define a first opening 40. Similarly, a second aperture 42 in the upper portion 20 and a second aperture 44 in the lower portion 22, each proximate the second end 28, are axially aligned to define a second opening 46.

An elongate planar base 50 is attached to the arm rest stand 51 of a chair 53. Fixedly attached to the base 50, for example, by welding, is one end 48 of a first shaft 14. The other end 52 of the first shaft 14 is rotatably coupled to the elongate component 12 at the first opening 40. A second shaft 16 is fixedly attached at one end 54 to an arm rest support 56, and its other end 58 is rotatably coupled to the elongate component at the second opening 46. The arm rest support 56 is attached to the arm rest 11 by conventional means.

A pressure adjustment mechanism 18 includes a pressure plate 60 having a generally rectangular shape defining a first shorter end 62 and a second shorter end 64, a first longer end 66 and a second longer end 68. Each shorter end 62, 64 defines a respective arcuate section 70, 72 proximate the first longer end 66. A bore 74 is located medially of the first longer end. A threaded rod 76 is fixed in and projects outwardly from the bore.

In operation, the pressure plate 60 is located in the slot 21 between the upper portion 20 and the lower portion 22 of the elongate component 12 with an arcuate section 70, 72 proximate each shaft 14, 16 and the rod 76 passing through the hole 34 in the end portion 24. A pressure adjustment nut 78 is threaded onto the portion of the threaded rod 76 protruding through the hole 34. The nut 78 is loosened or tightened to adjust the contacting pressure between each shaft 14, 16 and the respective arcuate sections 70, 72 of the pressure plate 60. The contacting pressure is initially adjusted to provide the force desired to position the arm rest, and need only be readjusted to compensate for wear of the contacting parts.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A mechanical linkage for adjustably coupling an arm rest to an arm rest base in a chair, comprising:

(a) an elongate component having first and second ends;

(b) first attachment means for connecting said elongate component rotatably to said arm rest base proximate said first end;

(c) second attachment means for connecting said elongate component rotatably to said arm rest proximate said second end; and (d) single pressure adjustment means for simultaneously applying a variable amount of resistance against the rotation of both said first and second attachment means.

2. The mechanical linkage of claim 1, wherein said first and second attachment means comprise:

(a) said elongate component defining a first opening proximate said first end, and a second opening proximate said second end;

(b) an arm rest support, which is attached to the arm rest, having a first shaft fixedly attached thereto, said first shaft having a projecting portion which is rotatably coupled to said elongate component at said first opening; and (c) a second shaft fixedly attached to the arm rest base, having a projecting portion which is rotatably coupled to said elongate component at said second opening; wherein (d) said pressure adjustment means adjustably contacts said first shaft and said second shaft simultaneously.

3. The mechanical linkage of claim 2 wherein said elongate component has a medial slot defined therein which passes through said openings, and said pressure adjustment means is located within said slot.

4. The mechanical linkage of claim 3, said pressure adjustment means further including a pressure plate having opposed ends each containing an arcuate section, said arcuate sections being located to respectively contact said shafts when said pressure plate is placed in said slot.

5. The mechanical linkage of claim 4, said pressure adjustment means further including means to adjustably urge said arcuate sections against said shafts.

6. A mechanical linkage for adjustably coupling an arm rest to an arm rest base in a chair, comprising:

(a) an elongate component having first and second ends;

(b) first attachment means for connecting said elongate component rotatably to said arm rest base proximate said first end;

(c) second attachment means for connecting said elongate component rotatably to said arm rest proximate said second end; and (d) pressure adjustment means for applying a variable amount of resistance against the rotation of said first and second attachment means;

(e) wherein said first and second attachment means comprise:

(i) said elongate component defining a first opening proximate said first end, and a second opening proximate said second end;

(ii) an arm rest support, which is attached to the arm rest, having a first shaft fixedly attached thereto, said first shaft having a projecting portion which is rotatably coupled to said elongate component at said first opening; and (iii) a second shaft fixedly attached to the arm rest base, having a projecting portion which is rotatably coupled to said elongate component at said second opening;

(iv) said pressure adjustment means adjustably contacting said first shaft and said second shaft;

(v) said elongate component having a medial slot defined therein which passes through said openings, and said pressure adjustment means being located within said slot.

7. The mechanical linkage of claim 6, said pressure adjustment means further including a pressure plate having opposed ends each containing an arcuate section, said arcuate sections being located to respectively contact said shafts when said pressure plate is placed in said slot.

8. The mechanical linkage of claim 7, said pressure adjustment means further including means to adjustably urge said arcuate sections against said shafts.

* * * * *